United States Patent [19]

Braddock

[11] Patent Number: 4,478,132

[45] Date of Patent: Oct. 23, 1984

[54] ROTARY MOTOR

[76] Inventor: Elijah Y. Braddock, Box 182, Columbia City, Ind. 46725

[21] Appl. No.: 505,062

[22] Filed: Jun. 16, 1983

[51] Int. Cl.[3] ..... F01B 13/06

[52] U.S. Cl. ..... 91/485; 91/491

[58] Field of Search ..... 91/484–487, 91/491, 492, 402; 417/489

[56] References Cited

U.S. PATENT DOCUMENTS

| | | | |
|---|---|---|---|
| 2,101,829 | 12/1937 | Benedek | 91/498 |
| 2,250,031 | 7/1941 | Nathan | 91/487 |
| 2,525,498 | 10/1950 | Naylor et al. | 91/491 |
| 3,075,504 | 1/1963 | Vogel | 91/491 |
| 3,225,701 | 12/1965 | Griffith | 91/491 |
| 3,287,993 | 11/1966 | Lomnicki | 91/491 |
| 3,370,511 | 2/1968 | Gibbs et al. | 91/402 |
| 3,657,970 | 4/1972 | Kobayashi et al. | 91/487 |
| 3,788,286 | 1/1974 | Brewer | 91/491 |
| 4,192,221 | 3/1980 | Robinson | 91/487 |

FOREIGN PATENT DOCUMENTS

| | | | |
|---|---|---|---|
| 3100913 | 1/1982 | Fed. Rep. of Germany | 91/491 |
| 345534 | 5/1960 | Switzerland | 91/485 |
| 2784 | of 1913 | United Kingdom | 91/492 |
| 136681 | 12/1919 | United Kingdom | 91/492 |

OTHER PUBLICATIONS

Scott, David, "Exciting New Rotary Engine is Piston--Powered," Popular Science Magazine, Dec., 1969, pp. a–e.

*Primary Examiner*—William L. Freeh
*Assistant Examiner*—Paul F. Neils
*Attorney, Agent, or Firm*—George A. Gust

[57] ABSTRACT

A fluid motor operable from a source of pressurized fluids such as compressed air or steam which includes a hollow stationary housing and a rotating housing journaled therein. A plurality of pistons are reciprocally, radially received in the rotating housing and act radially outwardly against an eccentric cam surface.

7 Claims, 10 Drawing Figures

ROTARY MOTOR

BACKGROUND OF THE INVENTION

1. Field of the Invention

The invention relates to motors which use a pressurized fluid such as air or steam and in particular to such a motor having an array of pistons radially reciprocal in a rotating housing wherein the pistons exert a driving force against a stationary eccentric surface, and the motor's output shaft is operatively coupled to the rotating housing.

2. Description of the Prior Art

Radial motors which incorporate pistons which act radially outwardly against a cam surface to impart rotary motion to a rotatable housing carrying the pistons are well known. Such a motor is, for example, disclosed in U.S. Pat. No. 663,716 to C. H. Asling et al. In such motors, power is derived from a pressurized fluid, such as compressed air or steam. The pressurized fluid is used to force a piston radially outwardly within a rotating housing. The radially outwardly disposed ends of the pistons act by means such as rollers or the like against an eccentric cam surface formed on the inside of a housing which encloses the rotary housing. As the pistons act against the cam surface, they extend and retract reciprocally and impart rotational force on the housing to produce power.

However, radial motors of the general type herein disclosed have heretofore lacked the mechanical refinement necessary to render such a motor compact relative to its displacement, and exhibit deficiencies in their porting and the mechanical coupling between the pistons and the eccentric cam shaft surface necessary to provide maximum efficiency and economy in their construction. Accordingly, there exists a need for an improved rotary motor or engine incorporating radially reciprocal pistons acting against an external eccentric cam surface in which the arrangement of the pistons, ports, and piston drive elements are arranged for maximum efficiency.

SUMMARY OF THE INVENTION

Broadly, the invention is a fluid motor which has a stationary housing and a rotating housing journaled within the stationary housing for rotation about a predetermined axis. A plurality of cylinders are formed in the rotating housing, the cylinders extending radially outwardly with respect to the axis. A piston is reciprocally received in each of the cylinders. At least one eccentric cam surface is provided in the stationary housing and is disposed in a plane perpendicular to the motor's axis. This eccentric cam surface has at least one cam surface portion which is disposed at an inclined angle with respect to the movement of the pistons. Inlet and exhaust ports are provided for applying pressurized fluid and exhausting pressurized fluid from the pistons, respectively, in a predetermined timed sequence.

In a specific embodiment of the invention, the motor is further provided with a plurality of inlet ports mounted within the stationary housing and operatively engaged with the rotating housing for timed operation in synchronization with movement of the rotating housing.

Preferably, the motor cam surfaces includes at least two symmetrically disposed inclined surfaces and there are two cam surfaces disposed in diametrically opposed relationship to the rotating housing, the rotating housing rotating therebetween. Cam followers are fixedly secured to the pistons through radially extending slots provided in the cylinders, the cam followers rolling on the cam surfaces. The aforementioned slots are positioned and dimensioned to also provide exhaust ports for the cylinders at predetermined points in the stroke of the pistons.

It is therefore an object of the invention to provide an improved pressurized fluid motor.

Another object of the invention is to provide such a motor which includes a stationary housing and a rotating housing journaled therein, the rotating housing having a plurality of radially reciprocal pistons therein.

Yet another object of the invention is to provide such a motor which includes inlet ports communicating with the rotating housing, the ports being responsive to the position of the rotating housing for operation between open and closed conditions.

Still another object of the invention is to provide such a motor including two cam surfaces disposed in axially spaced-apart relationship and operatively, symmetrically engaged with a pair of spaced-apart cam followers secured to the motor's pistons to provide symmetrical force balance therebetween.

Another object of the invention is to provide such a motor in which the exhaust ports also accommodate movement of the cam followers.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE PREFERRED EMBODIMENT

Figure 2:
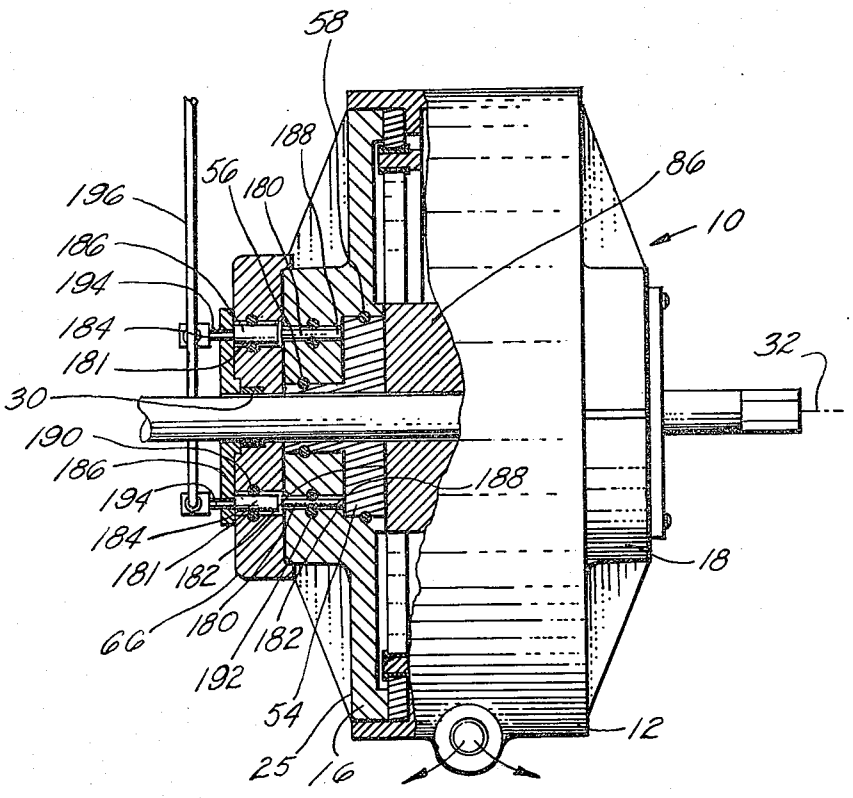
FIG. 2 is a side plan view of the motor partially sectionized to show details of a fluid pressure seal used therein.

Referring now to the drawings, there is shown a motor in accordance with the present invention indicated generally at 10. The motor comprises a stationary housing 12 which having a generally hollow, cylindrical center portion 14 and generally circular end plates 16, 18. The center section is provided with a pair of parallel spaced-apart annular ridges 20, 22 which define an annular recess 24 therebetween.

End plate 16 has a stepped diameter external surface 25 and an annular recess 26 formed in its interior wall 28. A central bore 30, also of stepped diameter, is formed in the end plate 16, this bore being concentric with the axis 32 of the motor.

Similarly, end plate 18 is provided with an arcuate recess 34 in its interior surface 36. A stepped diameter internal bore 38 is formed in the plate 18 concentric with the axis 32.

A pair of cam plates 40, 42 having circular outside peripheries and eccentric cam surfaces 40, 50 are fixedly secured between respective ones of the end plates 16, 18 and housing center portion 14. The cam plates 40, 42 will be described in more detail below. For the moment it is sufficient to say that they have irregular internal openings as at 52.

Figure 3:
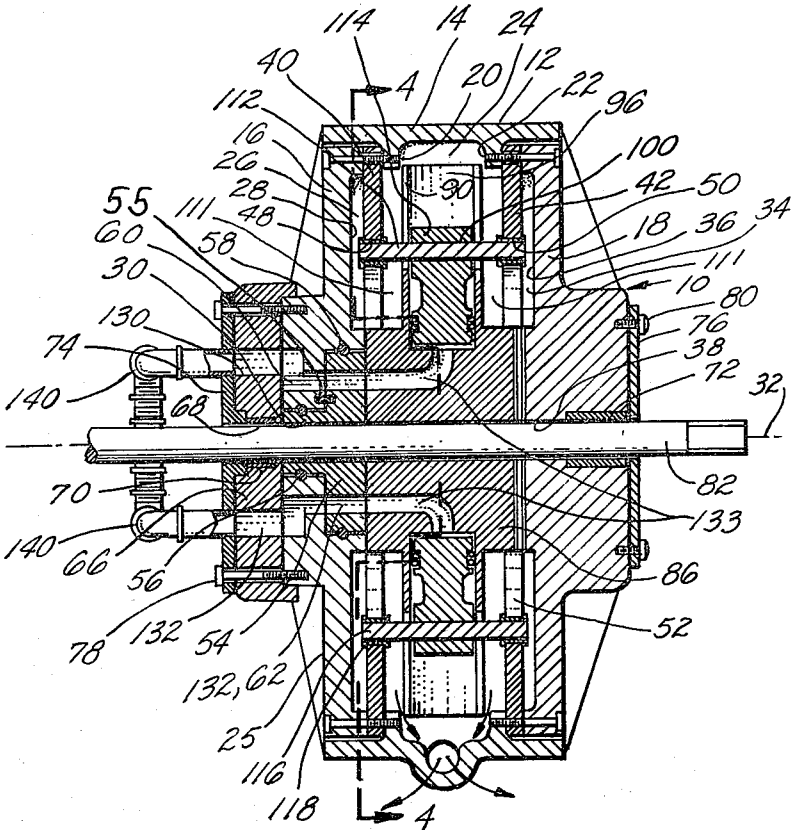
FIG. 3 is an axial sectional view of the motor.

An inlet port member 54 has a stepped cylindrical external surface complementary to the stepped diameter bore 30, the member 54 being received therein and secured against rotation by means of a pin 55 (FIG. 3) fitting into both member 54 and plate 16. Preferably, a plurality of seals such as O-rings 56, 58 are interposed between the inlet port member 54 and end plate 16 to provide a fluid tight seal therebetween. Again, as will be explained in more detail below, a plurality of inlet ports 60 are provided in the hub portion of the end plate 16 in positions where they will intermittently communicate with the corresponding inlet ports 62 provided in the inlet port member 54.

The facing surfaces of member 54 and rotating housing 86 are ground smooth so that engagement can provide a substantial seal against fluid (air or steam) leakage therebetween. This seal can be improved by some oil type lubricant added in some suitable manner such as being included in the motive air, for example, used as the power source.

An annular bearing plate 66 is fixedly secured to end plate 16, bearing plate 66 having central bore 68 concentric with the axis 32. Cylindrical bearings 70, 72 are fixedly received in the bores 68 and 38 respectively, the bearings 70, 72 being maintained in position by bearing retainer plates 74, 76, respectively, and the latter being secured to end plates 16, 18 by means of threaded fasteners as at 78, 80.

Figure 4A:
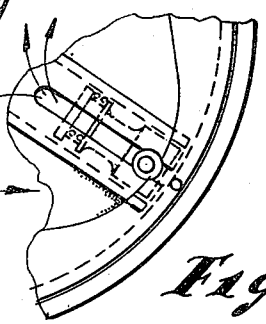
FIG. 4*a* is a close-up sectional view of a piston and cylinder assembly.
Figure 4:
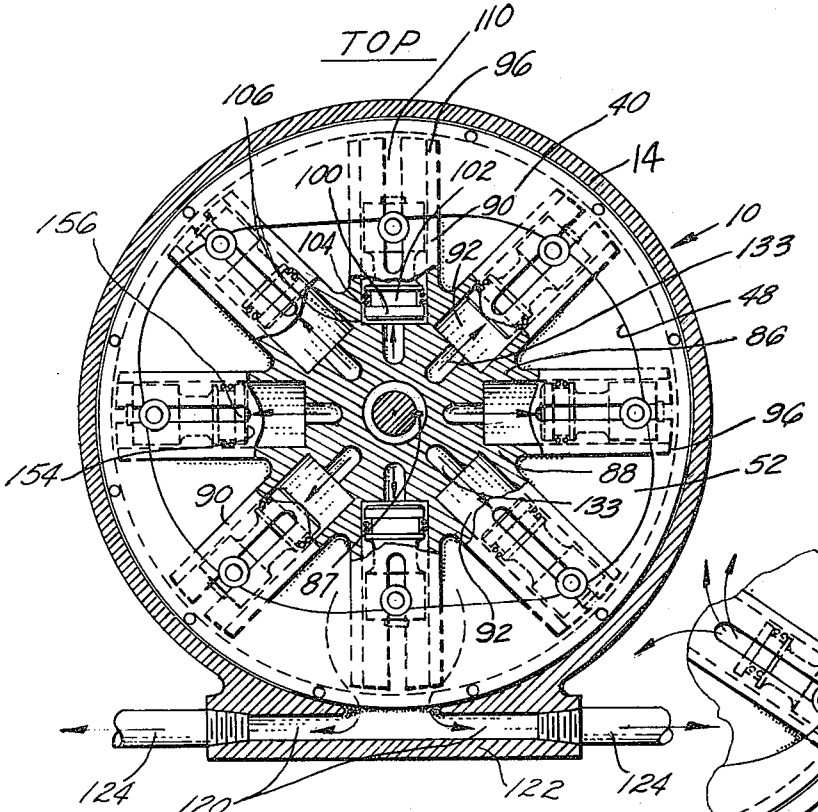
FIG. 4 is a sectional view of the motor taken along section line 4—4 of FIG. 3.

Rotatably received in the bearings 70, 72 is an output shaft 82. A rotating housing 86 is fixedly mounted on the shaft 32 inside stationary housing 12. Shaft 82 is drivingly coupled to rotating housing 86 by means of a key 87, (FIG. 4 only). As can best be seen in FIG. 4, the rotating housing 86 includes a central hub section 88 and a plurality of cylinder portions 90 extending radially outwardly therefrom. In the illustrated embodiment, there are eight cylinder portions 90, arranged in a symmetrical array similar to the spokes of a wheel. Each of the portions 90 extending radially outwardly therefrom. In the illustrated embodiment, there are eight cylinder portions 90, arranged in a symmetrical array similar to the spokes of a wheel. Each of the portions 90 is identical and a description of one will suffice for all. Within each of the sections 90 is formed a cylinder 92, the cylinder 92 extending partially into the center section 90 and being open at its distal end 96. The ends of portions 90 are arcuate and positioned to move in close proximity to the internal surface of the center portion 14 of the stationary housing 12.

Slidably, reciprocally received in each of the cylinders 92 is a piston 100. The pistons 100 are of generally cylindrical configuration and are provided with annular grooves 102 in which are received a plurality of sealing rings 104 which provide a sliding, fluid tight seal between the pistons 100 and the walls of the cylinders 92. A fluid passage 133 communicates with the radially inwardly disposed end 106 of each of the cylinders 92, these fluid passages communicating with the ports 62.

The side walls of portions 90 that are axially displaced relative to the axis 32 are provided with elongated slots 110, the slots 110 being aligned and communicating between the cylinders and the annular cavities 111 defined between rotating housing 86 and end plates 16, 18. A drive pin 112, extends through each of the pistons 100 adjacent its outwardly disposed end 114, the drive pins 112 extending axially outwardly through the slots 110 and into the openings 52 in cam plates 40, 42. Rotatably received on the ends 116 of pins 112 are cam rollers 118. Preferably, the cam rollers 118 have recessed cylindrical surfaces dimensioned to radially and axially engage the cam plates 40, 42.

Figure 9:
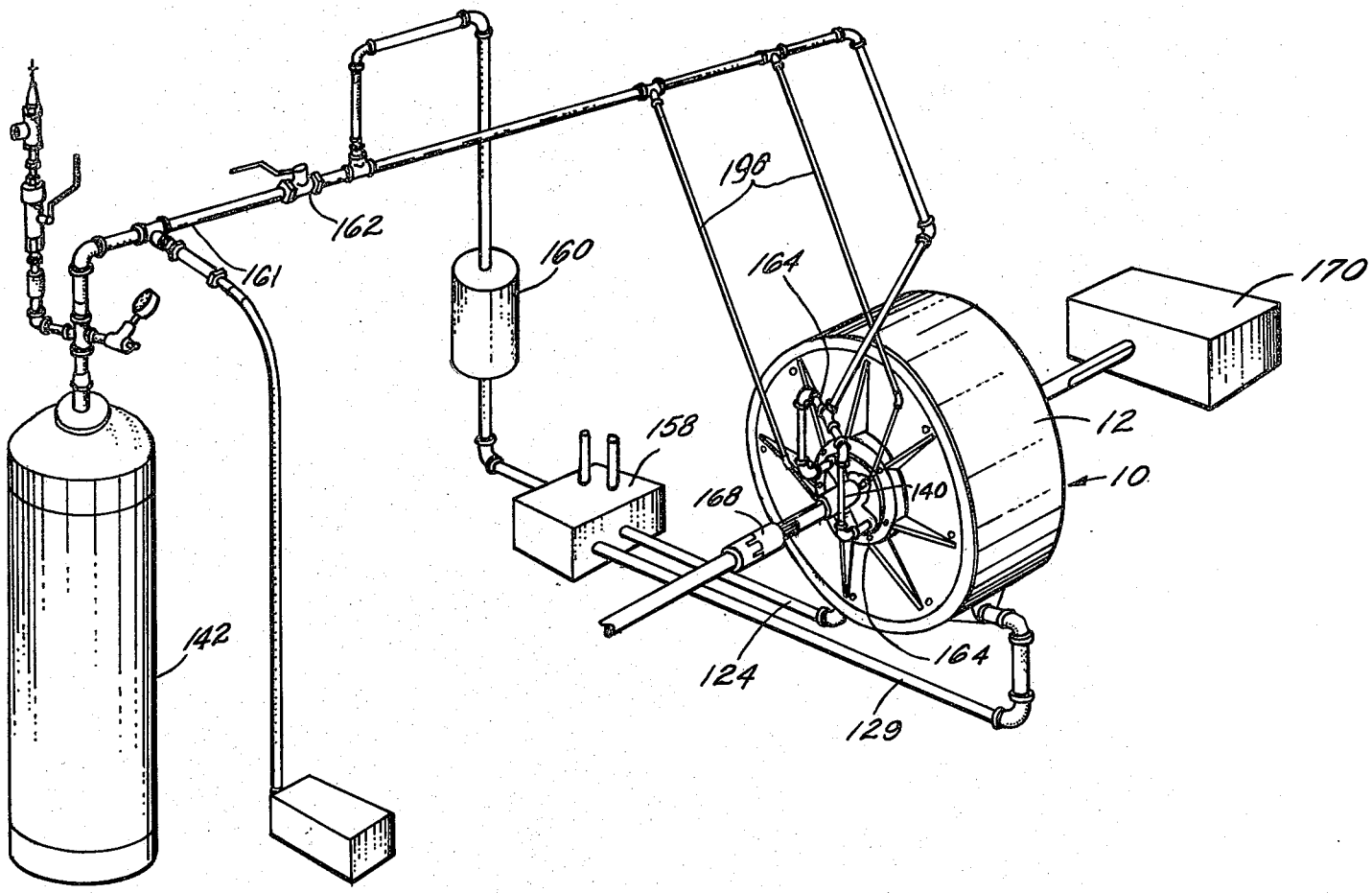
FIG. 9 is a perspective drawing showing the motor of the present invention connected to a source of pressurized fluid.

Communicating between recesses 24 and the exterior of housing 12 are fluid passages 120 which extend through suitable enlargements 122 formed as integral parts of stationary housing 14. These passages 120 may communicate with the atmosphere or suitable exhaust conduits 124 (FIGS. 4 and 9 only).

Figure 5:
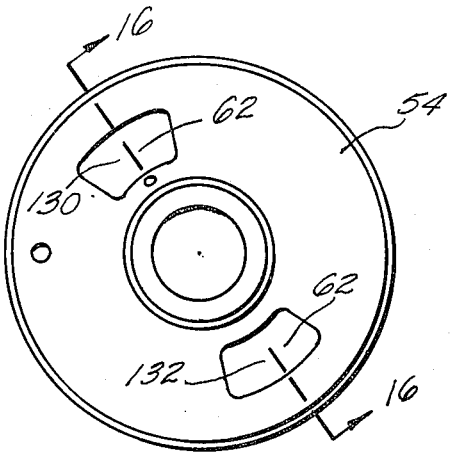
FIG. 5 is an axial plan view of the inlet port member of the present invention.
Figure 6:
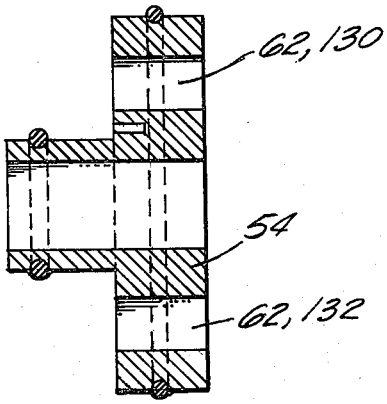
FIG. 6 is an axial section view of the inlet port member taken along section line 6—6 of FIG. 5.
Figure 7:
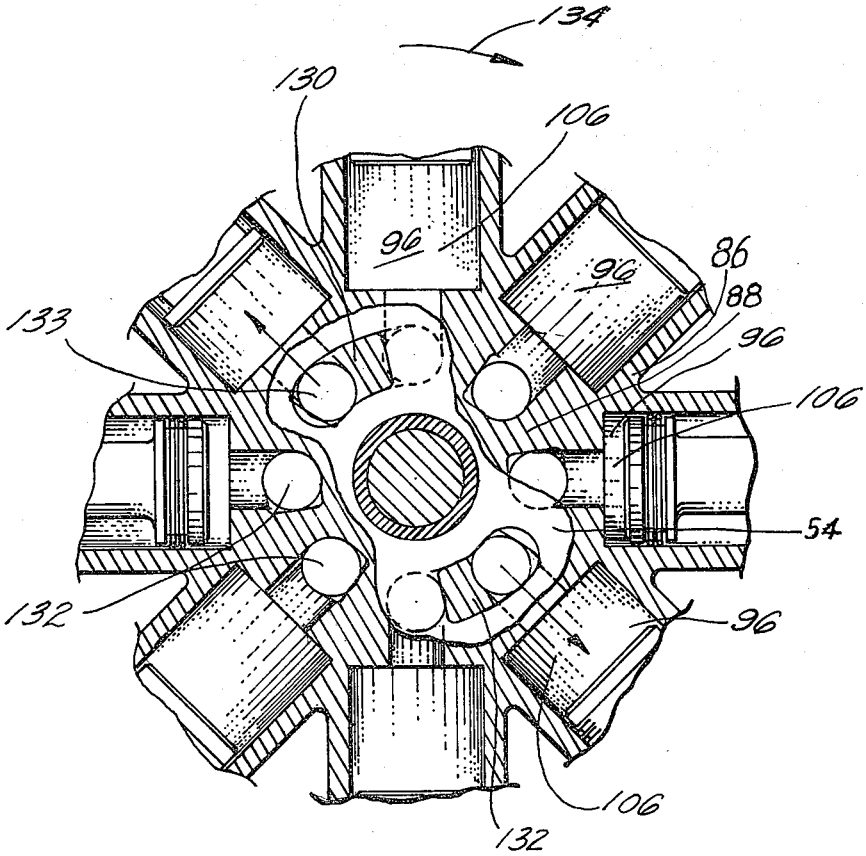
FIG. 7 is a sectionalized axial view of the motor showing details of the inlet ports thereof.

Referring now specifically to FIGS. 5 through 8, the details of the pressurized fluid porting will be explained. In FIG. 5, there is shown in plan the inlet port member 54. This member, of generally circular stepped diameter periphery, is provided with a pair of diametrically positioned ports 130, 132, earlier identified by the numeral 62. The ports 130, 132 are elongated arcuate slots and extend through a predetermined arc of about 30°. These ports 130, 132 extend through the member 54 communicating at their inwardly disposed ends with fluid passages 133 which communicate with the inwardly disposed ends 106 of the cylinders 96. The member 54 is stationary while the rotating housing 86 rotates relative thereto as indicated by arrow 134 (FIG. 7 only). Accordingly, individual ones of the inlet ports 133 will be seen to move sequentially into and out of registry with the ports 130, 132. For each port 133, this occurs at a specific predetermined point in the rotation of the rotating housing 86 and also terminates at a predetermined point in this rotation. Once a respective one of the ports or passages 133 moves out of registry with the ports 130, 132, the ports 133 are sealed until such time as they again move into registry with the next of the ports 130 or 132. The ends of ports 130, 132 distal their communication with the ports 133, communicate through a manifold and bearing plates 66, 74 with a conventional pressurized fluid lines 140 which are in turn coupled to a source of pressurized fluid such as a pressure tank 142 (FIG. 9 only) associated with an air compressor or the like (not shown).

Figure 8:
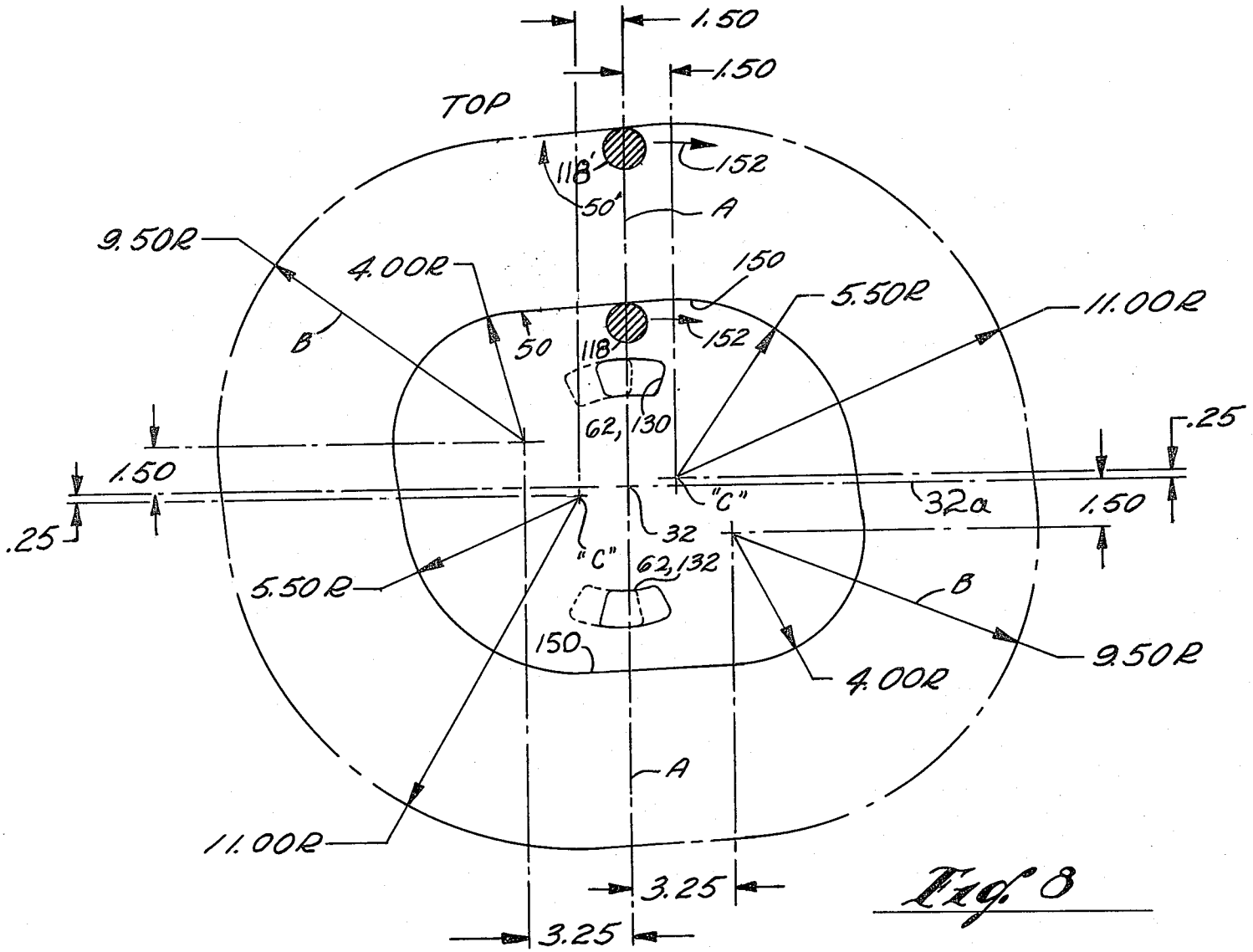
FIG. 8 is a dimensioned diagram showing details of a cam surface for use with the motor and useful in explaining the stroking operation of the motor.

With specific reference to FIG. 8, the disposition of the ports 130, 132 relative to the eccentric cam surfaces of the cam plates 40, 42 will be seen. It will be seen that the cam plates 40, 42 (these are identical so only cam plate 40 will be described in detail) are provided with an irregular or eccentric internal surface 150. This surface is illustrated with two different sets of dimensions (to be later explained) used in working embodiments, the shape of this surface resembling a parallelogram with rounded corners. The longer surfaces 150 are flat but slightly inclined as the indicated dimensions show, this inclination being further shown with reference to the horizontal center line 32a which passes through the axis 32 of the motor. As seen in FIG. 8, upper surfaces 150 is straight and inclines toward the left.

A vertical radius or point "A" extending from axis 32 intersects surfaces 150 about midway between the ends thereof, and the centerline 32a similarly intersects the straight end surfaces as shown. By reason of this inclination of surfaces 150, it will be seen that as the cam pins and followers 118 proceed, as indicated by arrows 152, the pistons 100 coupled to followers 118 will, under the influence of pressurized fluid in the cylinders 96, move radially outwardly. Due to the configuration of the cam surfaces 50, the surface portions 150 act as an inclined plane which causes the pistons to exert a torque force via the shafts 112 and pistons 100 against the rotatable internal housing 86. It will further be observed the ports 130, 132 are disposed such that they will in fact apply pressurized fluid to the ends 106 of the cylinders 96 at precisely the top or innermost point in the movement of the pistons 100. Accordingly, this pressurized fluid will exert the desired radially outwardly directed force against the pistons 100 just as they commence movement along the inclined plane positions 150 thereby imparting rotational movement into the inner housing.

As the pistons move radially outwardly, they eventually reach a point whereat pins 112 reach the outer ends of the slots 110. At this point, pressurized fluid, such as compressed air, within the cylinders 96 will have been exhausted through the slots 110. This pressurized fluid is thus exhausted into the arcuate recesses 34 and 111 is expelled through ports 120 and conduits 124. This exhausted fluid is vented to the atmosphere through a muffler or the like 158 which collects oil from the exhausted fluid for recirculation. This exhausting of the pressurized fluid continues as long as the upper edge or surface 154 of the pistons 100 remains radially outwardly displaced from the ends 156 of slots 110.

As the inner housing continues to rotate, the cam followers 118 reach a point on the surfaces 150 wherein the radial displacement of the surface from axis 32 begins to decrease. Continual movement forces the pistons radially inwardly moving them back towards the tops 106 of the cylinders 100. Another charge of pressurized fluid is subsequently applied thereto when the passage 133 communicating therewith moves into registry with the next intake port 130, 132.

The cam surfaces 150 have been configured to provide a substantially linear movement of the pistons 100 as they rotate but with appropriate acceleration and deceleration curvatures being provided at the beginning and end of the stroke for obvious mechanical reasons.

Still referring to FIG. 8, it will be seen that there are two separate sets of dimensions illustrated. In one set of dimensions, the maximum displacement of the surface 150 from axis 32 is 5.50 inches from a point "C" which represents the top of the piston movement. Similarly, this surface 150 has a minimum dimension of 4.00 inches from the indicated center. A similar surface is also shown at 50' in which the maximum dimensions and the minimum dimensions are eleven inches and 9.5 inches, respectively.

Thus, the distance from axis 32 to the surface 50' is about twice that to the surface 50. The surface 50' is shown only to illustrate that by keeping the dimensions of the cylinder bores and the piston stroke the same as well as the air pressure, the leverage about axis 32 exerted on cam follower 118 is essentially doubled. Explained otherwise, considering the radius arm to the illustrated cam follower 118' from axis 32 to be double that from axis 32 to illustrated follower 118, the leverage exerted at right angles on follower 118' would be twice that exerted on follower 118. Thus, in order to obtain greater leverage, essentially only the size of the cam surfaces 40,50 need to be enlarged as at 50'.

Figure 1:
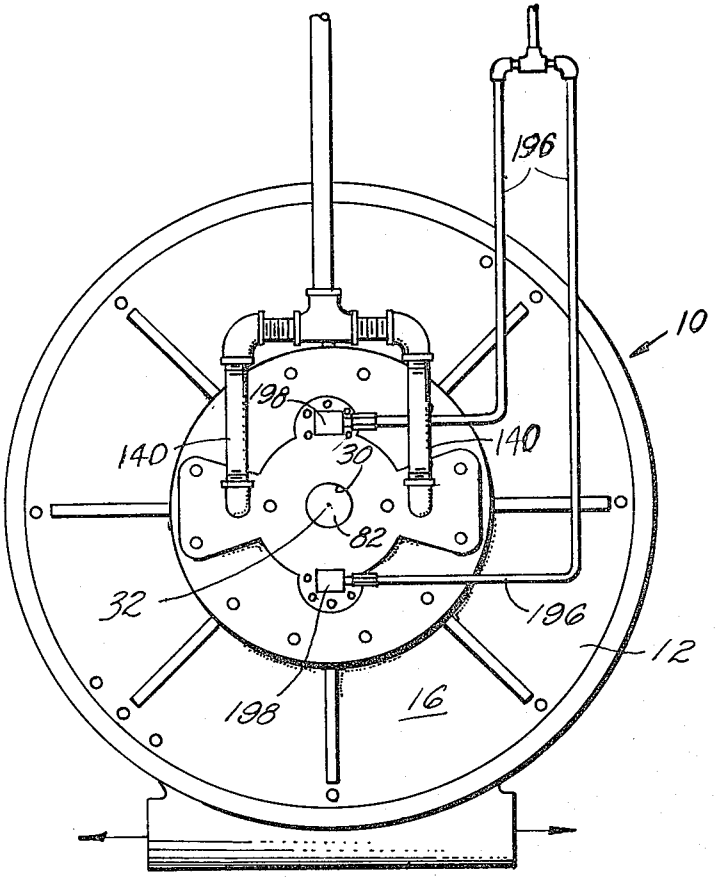
FIG. 1 is an end plan view of a fluid motor in accordance with the present invention.

Referring specifically to FIGS. 1 and 2 there is shown details of a novel means for ensuring a positive fluid tight seal between the engaged, flat, radial surfaces of inlet port member 54 and rotating housing 86. A pair of cylindrical holes 180 (FIG. 2) are formed in end plate 16 in registry with the shoulder surface 182 of inlet port member 54 and with their axes parallel with axis 32. A second pair of cylindrical holes 184 being of larger diameter than holes 180. A pressurized fluid cylinder 186 is received in each of holes 184. Cylinders 186 each include an actuator shaft 188 slidably axially received in respective ones of holes 180. A plurality of seals 58, 190, 192 are interposed between cylinders 186, shafts 188, and holes 184, 180, respectively, to provide a fluid tight seal therebetween. Cylinders 186 are operatively coupled to the same source of pressurized fluid (not shown in FIG. 2) used to provide energy from the motor 10 via fluid conduits 194, 196 and couplings as at 198. Actuator shafts 188 abuttingly engage surface 182. Accordingly, when pressurized fluid is applied to the cylinders 186, actuator shafts 188 apply a positive axial force against inlet port member 54 to maintain member 54 in positive sliding and sealing engagement with rotating housing 86. This force in the aggregate must exceed the counter force of the pressure fluid trapped in passages 133 when ports 62, 130, 132 close. This will be understood by considering that air under tank pressure passed through open ports 62, 130, 132 into passages 133 such that when these ports close, this air pressure becomes trapped in passages 133 by the member 54. The force of the trapped pressure tends to move member 54 toward the left and in a direction which breaks the seal with housing or rotor 86. It is thus important that the pins 188 push back (toward the right) with a greater force.

This is accomplished by sizing the diameter of plungers 181 such that the total area thereof which is exposed to tank pressure in line 196 provides for exertion of force against pins 188 sufficient to overcome the back pressure in passages 133 by an amount sufficient to assure sealing engagement of member 54 against rotor housing 86. Pressure in lines 196 is always at tank pressure when throttle valve 162 is open.

Referring specifically to FIG. 9, the pressurized fluid is contained in a storage tank 142 and passes via a pressure line 161 through a control or throttle valve 162, into a plurality of fluid lines 164 connected to the inlet lines 140. Similarly, the exhaust conduits 124 are coupled to the exhaust ports 120. Vaporized oil is accumulated in an accumulator or pump 160 for recirculation through the system. This pump 160, shown schematically, may be of conventional design and may be operated by means of another motor, fluid or electrically powered, to collect and recirculate the oil from the muffler or exhaust box 158 to the motor 10. Alternatively, oil may be continuously metered into the system to assure adequate lubrication and sealing. Appropriate pressure gauges, control valves and the like may be provided in the system as desired. The output shaft 82 is shown double ended and provided with conventional alignment couplings such as coupling 168 whereby the power generated by the motor 10 may be applied to any device such as a generator or the like shown schematically as box 170.

From the above description, it will be seen that the motor 10 of the present invention provides several distinct advantages over prior art rotary motors. Specifically, it will be seen that all of the power transmitted from the pistons 100 is applied against a laterally displaced cam surface 40, 50. This provides a motor in which there is no rocking or tilting force applied to the pistons that would increase friction or otherwise reduce efficiency of the device. The cam surface 40,50 because of its placement in the stationary housing 12, can be varied in dimension as shown in FIG. 8 and as previously explained to provide motors of varied power capacity without changing the bore size, stroke or air pressure. These cam surfaces 40,50 are further configured to provide a substantially linear rate of expansion of the variable volume chamber defined by cylinders 92 and pistons 100 as the rotating housing 86 moves. Use of cam plates 40, 42 having two eccentric surface portions 40,50 and a rotating housing with eight cylinders 92 provides a motor producing sixteen power strokes for each revolution thereby providing a motor of high power capacity in a compact physical size. The motor 10 can operate effectively using compressed air or steam.

It is theorized, referring once again to FIG. 8, that by increasing the radius or size of cam surfaces 40, 50 to obtain an increase in leverage and power, it is possible to provide a motor which will generate more power for the same air pressure, piston stroke and cylinder bore dimensions.

While there have been described above the principles of this invention in connection with specific apparatus, it is to be clearly understood that this description is made only by way of example and not as a limitation to the scope of the invention.

I claim:

1. A motor comprising: a hollow, generally cylindrical stationary housing, a rotating housing journaled for rotation about a fixed axis in said stationary housing, a plurality of cylinders in said rotating housing, said cylinders extending radially outwardly with respect to said axis, a piston reciprocally received in each said cylinder, a cam member fixedly mounted in said stationary housing and including a cam surface eccentric with respect to said axis and having at least one straight cam surface portion disposed at an inclined angle with respect to movement of said cylinders, the outer ends of said cylinders extending radially outwardly beyond said cam surface for all rotational positions of said housing, cam follower means fixedly secured to said pistons intermediate the ends thereof and operatively engaging said cam surface, inlet port means operatively connected between a source of pressurized fluid and said cylinders for synchronously, sequentially applying pressurized fluid to said cylinders as each said cylinder moves into registry with the proximal first portion of said cam surface portion, exhaust port means communicating between said cylinders and the exterior of said motor for synchronously, sequentially exhausting pressurized fluid from said cylinders as each said cylinder moves into proximity with the distal second portion of said cam surface portion, said pistons and said cam follower means being limited in movement between the opposite ends of the respective cylinders, said exhaust port means including elongated slots formed in the axially opposite walls of said cylinders, said slots communicating between the interior of said cylinders and the interior of said stationary housing, each said piston having a top surface portion, said top surface portion being disposed radially inwardly with respect to the radially inwardly disposed ends of said slots when said cylinder is in registry with the proximal portion of said cam surface portion and being radially displaced outwardly beyond said slot ends when said cylinders are in registry with distal portion of said cam surface portion, respectively.

2. A motor comprising: a hollow, generally cylindrical stationary housing, a rotating housing journaled for rotation about a fixed axis in said stationary housing, a plurality of cylinders in said rotating housing, said cylinders extending radially outwardly with respect to said axis, a piston reciprocally received in each said cylinder, a cam member fixedly mounted in said stationary housing and including a cam surface eccentric with respect to said axis and having at least one straight cam surface portion disposed at an inclined angle with respect to movement of said cylinders, the outer ends of said cylinders extending radially outwardly beyond said cam surface for all rotational positions of said housing, cam follower means fixedly secured to said pistons intermediate the ends thereof and operatively engaging said cam surface, inlet port means operatively connected between a source of pressurized fluid and said cylinders for synchronously, sequentially applying pressurized fluid to said cylinders as each said cylinder moves into registry with the proximal first portion of said cam surface portion, exhaust port means communicating between said cylinders and the exterior of said motor for synchronously, sequentially exhausting pressurized fluid from said cylinders, as each said cylinder moves into proximity with the distal second portion of said cam surface portion, said pistons and said cam follower means being limited in movement between the opposite ends of the respective cylinders, said cam member including an annular member disposed in a plane perpendicular to said fixed axis, said cam surface being the inside surface thereof, there are two of said cam members in said stationary housing, said cam members being disposed in axially spaced-apart relationship adjacent the axially opposite ends of said rotating housing, said cam surface includes an inclined plane having a dimension from said fixed axis which varies progressively circumferentially from said proximal portion to said distal portion, the radial distance between said axis and said distal portion being greater than that between said axis and said proximal portion, said radial distance from said first to said second portions increasing linearly in a direction of rotation of said rotating housing.

3. The motor of claim 2 wherein there are two of said inclined cam surface portions, said cam surfaces being in the form of parallelograms with the corners rounded.

4. The motor of claim 3 wherein said inlet port means includes fluid passages communicating between the proximal ends of said cylinders and an axially perpendicular exterior surface of said stationary housing, an inlet port member having a plurality of fluid ports and having a sealing surface slidably engaging said rotary housing perpendicular surface, said fluid ports and said fluid passages sequentially moving into and out of communication as said rotating housing rotates within said stationary housing.

5. The motor of claim 4 wherein further including means for maintaining said inlet port member in fluid-tight sealing engagement with said rotating housing perpendicular surface, said means for maintaining said inlet port member including at least one fluid pressure cylinder axially mounted in said stationary housing and having a plunger abutting said inlet port member on a surface thereof opposite said rotating housing, said plunger exerts a force on said inlet port member in a direction to force it into sealing engagement with said rotating housing, said fluid passages having air under pressure trapped therein during closure of said fluid ports which exerts a force against said inlet port member in an opposite direction, said plunger being exposed to the same air pressure as is admitted to said fluid passages via said fluid ports in said inlet port member, and said plunger being of a size as exerts a force when exposed to said air pressure sufficient to overcome the counterforce of pressure trapped in said fluid passages as aforesaid.

6. The motor of claim 5 wherein said inlet port member and said rotating housing having flat engaging surfaces which are perpendicular to the axis of rotation of said housing, said directions of force exerted by said plunger and trapped air being perpendicular to said engaging surface.

7. The motor of claim 6 wherein said inlet port member is affixed to said stationary housing against rotation to thereby have sliding engagement with said rotating housing.

* * * * *